US006723026B2

(12) United States Patent
Chen et al.

(10) Patent No.: US 6,723,026 B2
(45) Date of Patent: Apr. 20, 2004

(54) STEPPING EXERCISER HAVING RESISTANCE ADJUSTING DEVICE

(76) Inventors: Chiu Ku Chen, P.O. Box 63-99, Taichung (TW), 406; Chia Sheng Liao, P.O. Box 63-99, Taichung (TW), 406

( * ) Notice: Subject to any disclaimer, the term of this patent is extended or adjusted under 35 U.S.C. 154(b) by 165 days.

(21) Appl. No.: 10/073,032

(22) Filed: Feb. 12, 2002

(65) Prior Publication Data

US 2003/0153433 A1 Aug. 14, 2003

(51) Int. Cl.[7] ..... A63B 22/14
(52) U.S. Cl. ..... 482/53
(58) Field of Search ..... 482/51–53, 111–113, 482/137, 57

(56) References Cited

U.S. PATENT DOCUMENTS 4,159,111 A 6/1979 Lowth ..... 272/96
4,563,001 A 1/1986 Terauds ..... 272/72
5,004,224 A * 4/1991 Wang ..... 482/53
5,139,470 A 8/1992 Wang ..... 482/53
5,246,410 A * 9/1993 Fun ..... 482/53
5,320,588 A * 6/1994 Wanzer et al. ..... 482/53
5,658,223 A * 8/1997 Habing et al. ..... 482/53
6,315,697 B1 * 11/2001 Chen ..... 482/53

* cited by examiner

*Primary Examiner*—Stephen R. Crow

(57) ABSTRACT

A stepping exerciser includes two foot pedals rotatably secured on a base with a shaft, two actuators pivotally coupled between the foot pedals and the base, and a device for adjusting the actuators relative to the shaft, in order to adjust the resistance of the actuators applied onto the foot pedals. The base includes a curved slot formed in a housing for slidably receiving a rod. A block is slidably received in the base and has a channel for receiving the rod. An adjusting bolt is threaded to the block for moving the block and the rod relative to the base.

7 Claims, 4 Drawing Sheets

STEPPING EXERCISER HAVING RESISTANCE ADJUSTING DEVICE

BACKGROUND OF THE INVENTION

1. Field of the Invention

The present invention relates to a stepping exerciser, and more particularly to a stepping exerciser having a resistance adjusting device for adjusting to different resistances.

2. Description of the Prior Art

Various kinds of typical stepping exercisers have been developed and used today. U.S. Pat. No. 4,159,111 to Lowth discloses one of the typical stepping exercisers having a pair of foot pedals pivotally or rotatably secured or supported on a base for being conducted or actuated by the users in order to conduct stepping or walking exercises. The resistance force applied onto the foot pedals may not be adjusted.

U.S. Pat. No. 4,563,001 to Terauds discloses the other typical stepping exerciser having a pair of foot pedals pivotally or rotatably secured or supported on a base, and a pair of actuators or cylinders coupled to the foot pedals for applying a resistance force against the foot pedals. However, the resistance force of the actuators or the cylinders applied onto the foot pedals may not be adjusted.

U.S. Pat. No. 5,139,470 to Wang discloses a further typical stepping exerciser having a pair of foot pedals pivotally or rotatably secured or supported on a base, and a pair of actuators or cylinders coupled to the foot pedals for applying a resistance force against the foot pedals. In addition, a valve is coupled between the actuators or cylinders for adjusting the resistance force of the actuators or the cylinders applied onto the foot pedals. However, the moving strokes of the foot pedals may not be adjusted.

The present invention has arisen to mitigate and/or obviate the afore-described disadvantages of the conventional stepping exercisers.

SUMMARY OF THE INVENTION

The primary objective of the present invention is to provide a stepping exerciser including a resistance adjusting device for adjusting and for applying different resistances against the foot pedals.

In accordance with one aspect of the invention, there is provided a stepping exerciser comprising a base including a front portion and a rear portion, a pair of foot pedals including a front portion rotatably secured to the front portion of the base with a shaft, for allowing the foot pedals to be rotated up and down relative to the base about the shaft, a pair of cushioning devices including a first end pivotally coupled to the foot pedals respectively, and including a second end, and means for adjusting the second ends of the cushioning devices relative to the shaft, to adjust a resistance of the cushioning devices applied onto the foot pedals.

The base includes a curved slot formed in the front portion thereof, the adjusting means includes a rod slidably received in the curved slot of the base, and means for moving the rod along the curved slot of the base.

The moving means includes a block slidably received in the base and having a channel formed therein for slidably receiving the rod, and means for actuating the block to move relative to the base and to move the rod along the curved slot of the base.

The moving means includes means for guiding the block to move relative to the base. The guiding means includes a housing having a pair of panels extended therein and having a bottom portion, a base board secured to the bottom portion of the housing and having a pair of fences extended therefrom the block includes a lower portion slidably engaged between the fences, and an upper portion slidably engaged between the panels.

The actuating means includes an adjusting bolt rotatably received in the base, the block includes a screw hole formed therein for threading with the adjusting bolt, and for allowing the adjusting bolt to move the block along the adjusting bolt when the adjusting bolt is rotated relative to the base.

The adjusting bolt includes a first end extended outward of the base, and a knob secured to the first end thereof for rotating the adjusting bolt. The cushioning devices each includes an actuator having a first end secured to the rod.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
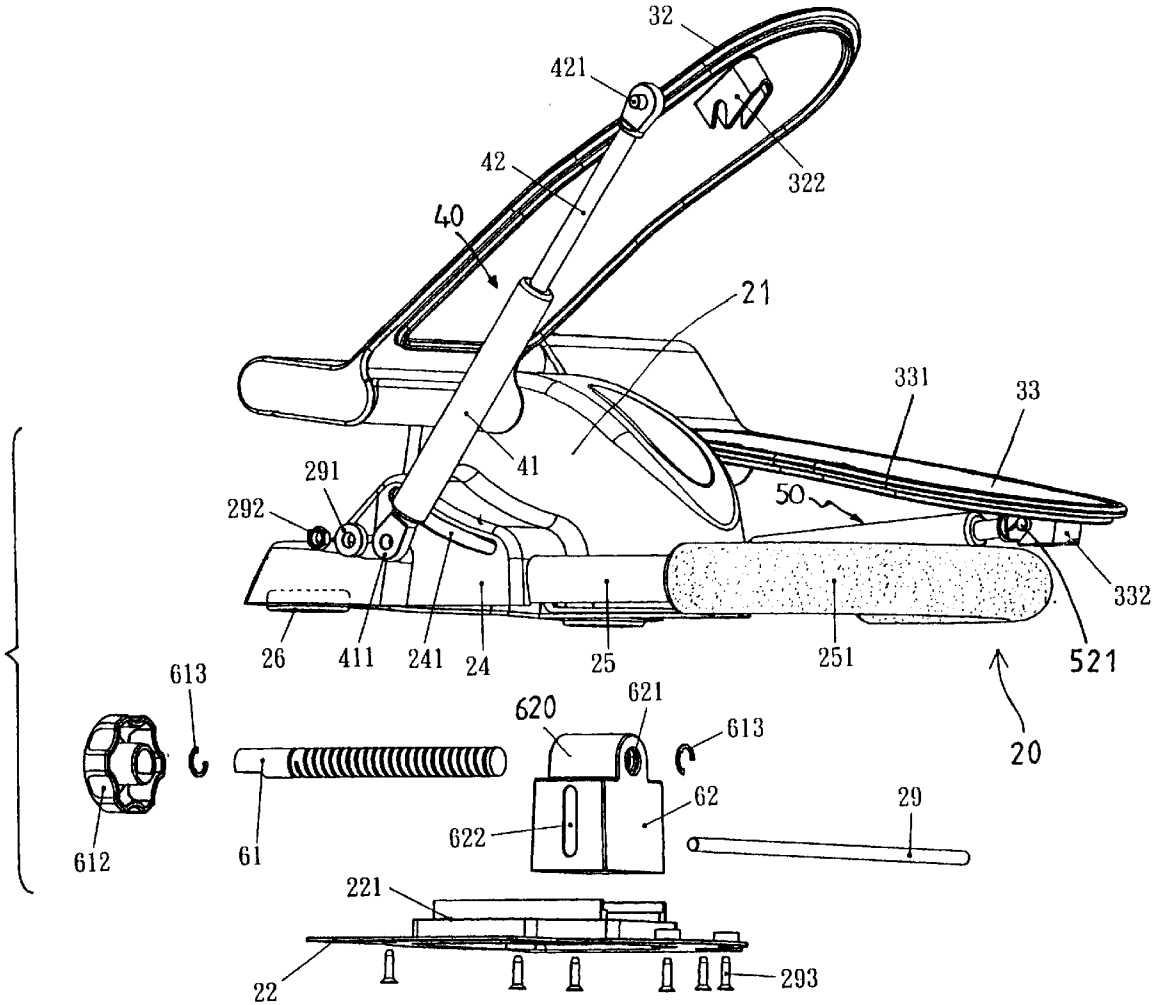
FIG. 1 is a partial exploded view of a stepping exerciser in accordance with the present invention.
Figure 2:
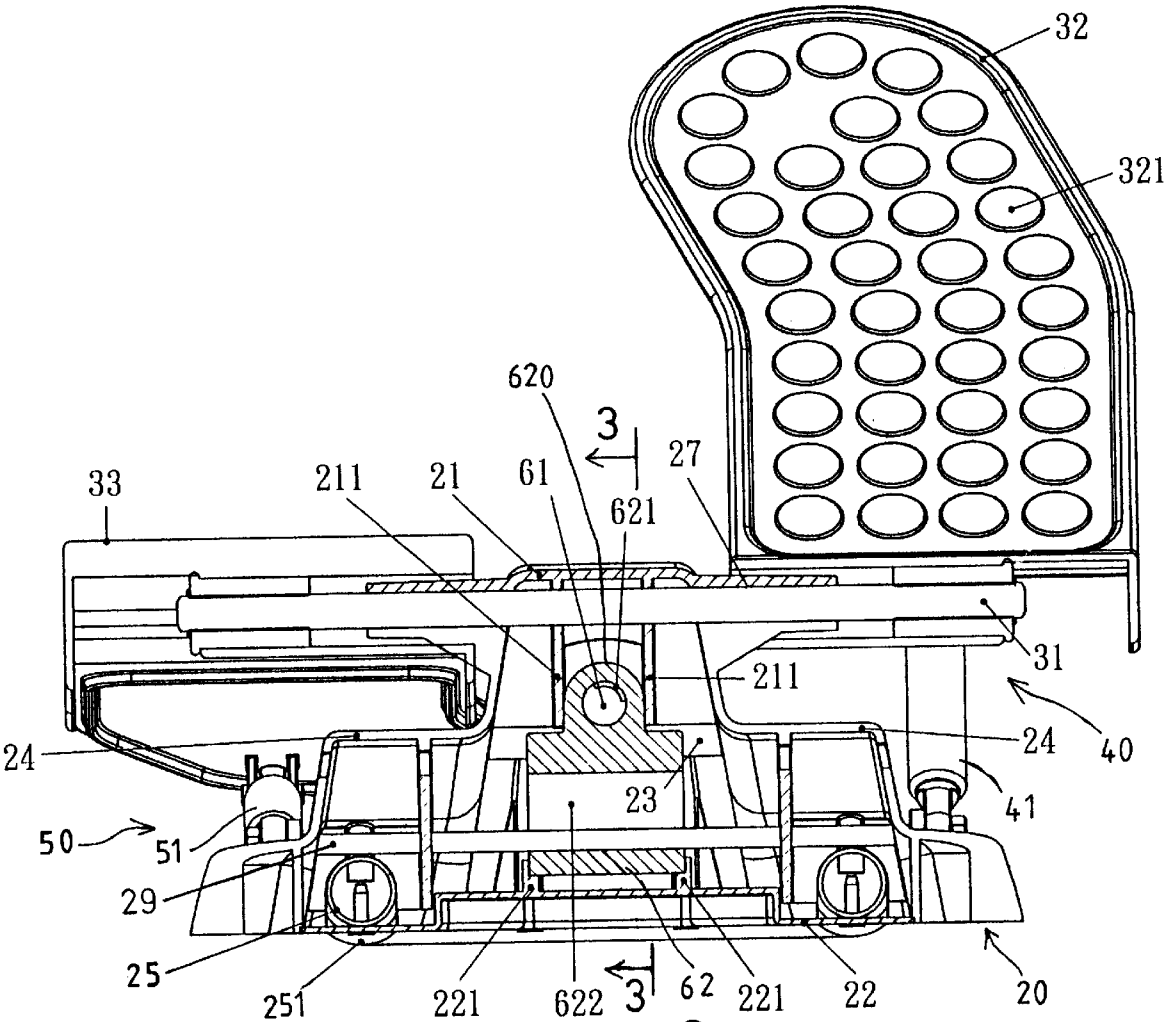
FIG. 2 is a partial cross sectional view taken along lines 2—2 of FIG. 3.
Figure 3:
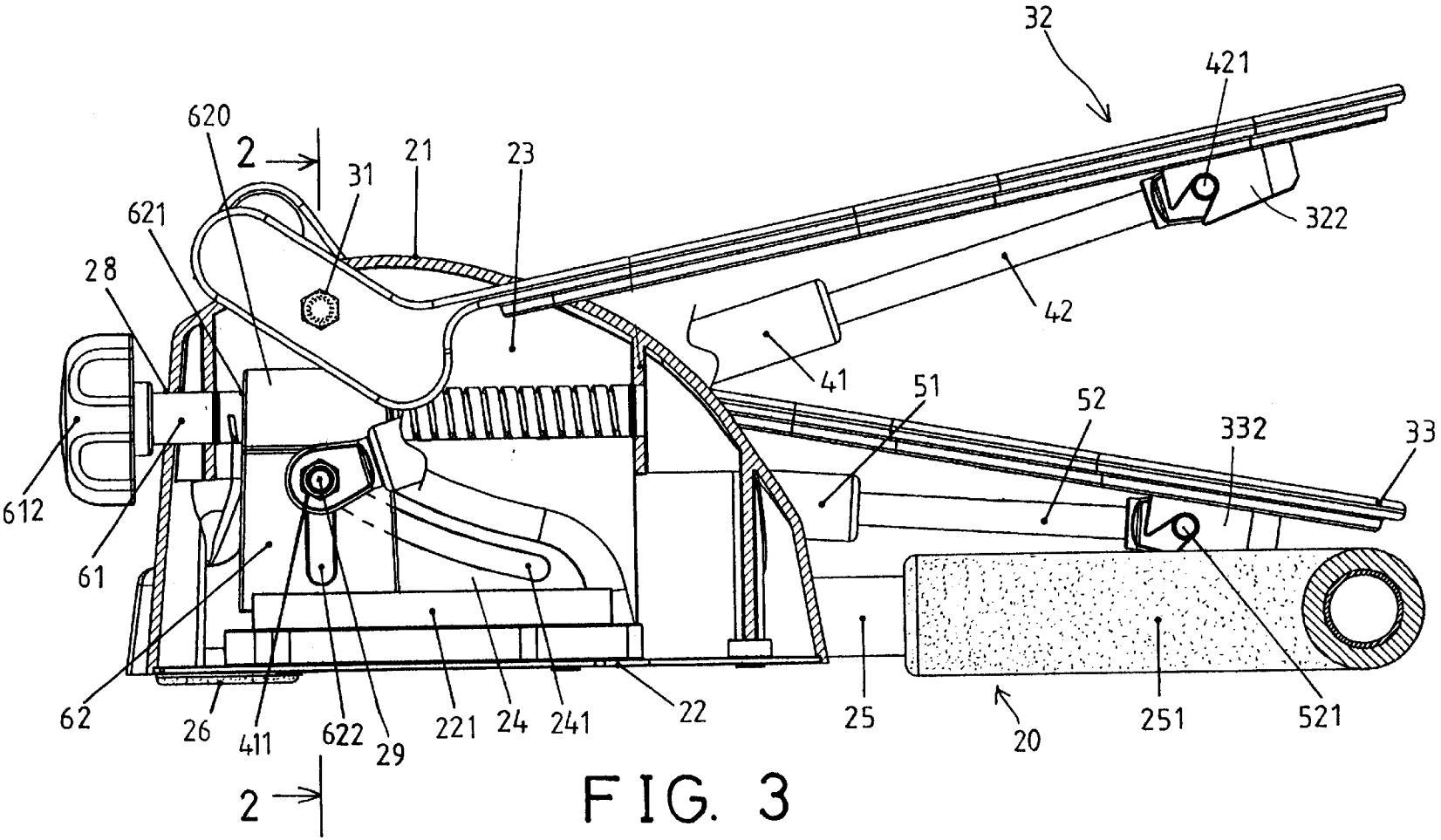
FIG. 3 is a partial cross sectional view taken along lines 3—3 of FIG. 2.

Referring to the drawings, and initially to FIGS. 1–3, a stepping exerciser in accordance with the present invention comprises a base 20 including a housing 21, and a base board 22 secured to the bottom of the housing 21 with such as fasteners 293. The base board 22 includes a pair of fences 221 extended upward therefrom, and preferably parallel to each other. The housing 21 includes a pair of panels 211 (FIG. 2) extended downward from the upper portion thereof and extended inward and toward a chamber 23 of the housing 21. The housing 21 includes two side walls 24. The base 20 includes a U-shaped frame 25 secured to the rear portions of the side walls 24 and a soft or resilient covering 251 attached onto the frame 25 for engaging onto the supporting surface. The base 20 may further include one or more pads 26 attached to the front and bottom portion thereof, also for engaging onto the supporting surface, and for preventing the stepping exerciser from moving relative to the supporting surface.

The base 20 or the housing 21 includes a lateral orifice 27 formed therein (FIG. 2) for receiving a shaft 31 therein. A pair of foot pedals 32, 33 each includes a front portion pivotally or rotatably secured onto the shaft 31, for allowing the foot pedals 32, 33 to be rotated or moved up and down relative to the base 20 about the shaft 31. The foot pedals 32, 33 each preferably includes a number of bulges or swellings 321, 331 of soft or resilient materials, for comfortably supporting the feet of the users, and for preventing the users from slipping relative to the foot supports 32, 33. The foot supports 32, 33 each further includes a bracket 322, 332 attached to the bottom portion thereof, and preferably disposed or located away from the shaft 31.

The base 20 or the housing 21 includes one or more curved slots 241 formed therein, for example, formed in the side walls 24 of the housing 21 respectively, for slidably receiving a rod 29 therein, and for allowing the rod 29 to be moved along the curved slots 241 of the side walls 24 of the housing 21. Two damping or cushioning devices 40, 50 are provided and coupled between the foot pedals 32, 33 and the base 20 for applying a resistance force against the foot pedals 32, 33, and each includes a cylinder or an actuator 41, 51 having one end 411 pivotally or rotatably secured to the ends of the rod 29 with such as the gaskets 291 and lock nuts 292, for allowing the ends 411 of the actuators 41, 51 to be moved along the curved slots 241 of the side walls 24 in concert with the rod 29. The actuators 41, 51 each includes a piston 42, 52 pivotally or rotatably secured to the brackets 322, 332 with pivot axles 421, 521 respectively.

The base 20 or the housing 21 includes a longitudinal aperture 28 (FIGS. 3, 4) formed therein for rotatably receiving an adjusting screw or bolt 61 which may be rotatably secured to the housing 21 with one or more clamping or retaining rings 613, and which includes one end or a front end extended outward of the housing 21. A knob 612 is secured to the front end of the adjusting bolt 61 for rotating the adjusting bolt 61 relative to the housing 21. A block 62 includes a lower portion slidably engaged between the fences 221 of the base board 22, and includes a projection 620 extended upward therefrom and slidably engaged between the panels 211 of the housing 21, for allowing the block 62 to be guided to move along the fences 221 and/or the panels 211, and/or the adjusting bolt 61 that is parallel to the fences 221 and the panels 211. The block 62 includes a screw hole 621 formed in such as the projection 620 thereof for threading with the adjusting bolt 61, and includes a channel 622 formed therein for slidably receiving the rod 29 therein. The rod 29 is thus slidably received in the channel 622 of the block 62, and simultaneously slidably received in the curved slots 241 of the side walls 24.

Figure 4:
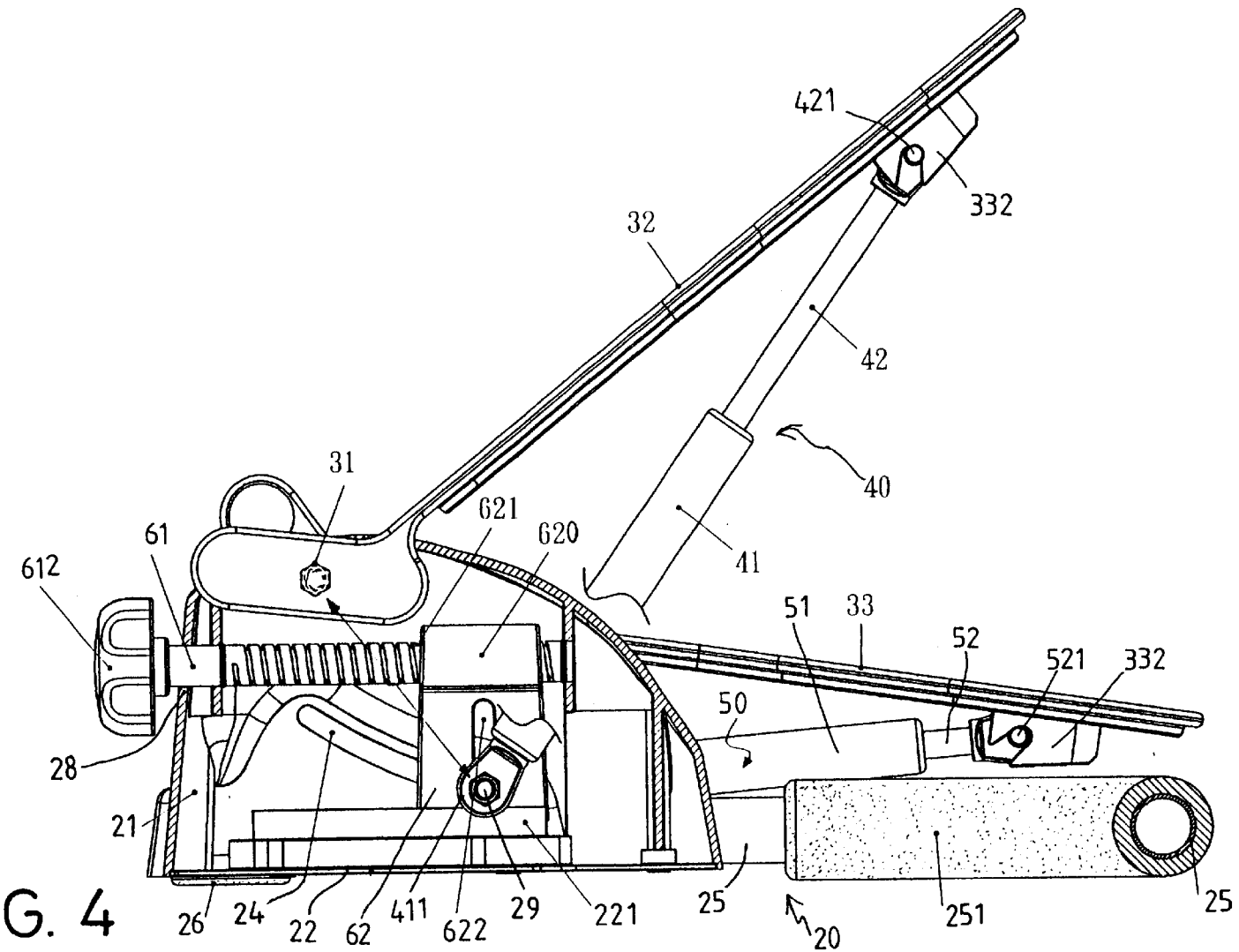
FIG. 4 is a partial cross sectional view similar to FIG. 3, illustrating the operation of the stepping exerciser.

In operation, as shown in FIGS. 3 and 4, when the adjusting bolt 61 is rotated relative to the housing 21 by the knob 612, the block 62 and thus the rod 29 may be adjusted to move along the adjusting bolt 61, in order to move the rod 29 along the curved slots 241 of the side walls 24. The rod 29 and thus the ends 411 of the actuators 41, 51 may be caused to move along the curved slots 241 of the side walls 24, in order to adjust the distance between the rod 29 and the shaft 31, and in order to adjust the included angle between the foot pedals 32, 33 and the actuators 41, 51.

For example, as shown in FIG. 3, when the block 62 is moved forward toward the knob 612, the rod 29 may be moved closer to the shaft 31, and the included angle between the foot pedals 32, 33 and the actuators 41, 51 may be reduced, such that the resistance force of the actuators 41, 51 applied onto the foot pedals 32, 33 may be decreased. As shown in FIG. 4, when the block 62 is moved rearward and away from the knob 612, the rod 29 may be moved away from the shaft 31, and the included angle between the foot pedals 32, 33 and the actuators 41, 51 may be increased, such that the resistance force of the actuators 41, 51 applied onto the foot pedals 32, 33 may be increased. The rotational movement of the moving stroke of the foot pedals 32, 33 may also be increased.

Accordingly, the stepping exerciser in accordance with the present invention includes a resistance adjusting device for adjusting and for applying different resistances against the foot pedals.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A stepping exerciser comprising:

a base including a front portion and a rear portion, said base including a curved slot formed in said front portion thereof, a pair of foot pedals each including a front portion rotatably secured to said front portion of said base with a shaft, for allowing said foot pedals to be rotated up and down relative to said base about said shaft, a pair of cushioning devices including a first end pivotally coupled to said foot pedals respectively, and including a second end, and means for adjusting said second ends of said cushioning devices relative to said shaft, to adjust a resistance of said cushioning devices applied onto said foot pedals, said adjusting means including a rod slidably received in said curved slot of said base, and means for moving said rod along said curved slot of said base.

2. The stepping exerciser according to claim 1, wherein said moving means includes a block slidably received in said base and having a channel formed therein for slidably receiving said rod, and means for actuating said block to move relative to said base and to move said rod along said curved slot of said base.

3. The stepping exerciser according to claim 2, wherein said moving means includes means for guiding said block to move relative to said base.

4. The stepping exerciser according to claim 3, wherein said guiding means includes a housing having a pair of panels extended therein and having a bottom portion, a base board secured to said bottom portion of said housing and having a pair of fences extended therefrom, said block includes a lower portion slidably engaged between said fences, and an upper portion slidably engaged between said panels.

5. The stepping exerciser according to claim 2, wherein said actuating means includes an adjusting bolt rotatably received in said base, said block includes a screw hole formed therein for threading with said adjusting bolt, and for allowing said adjusting bolt to move said block along said adjusting bolt when said adjusting bolt is rotated relative to said base.

6. The stepping exerciser according to claim 5, wherein said adjusting bolt includes a first end extended outward of said base, and a knob secured to said first end thereof for rotating said adjusting bolt.

7. The stepping exerciser according to claim 1, wherein said cushioning devices each includes an actuator having a first end secured to said rod.

* * * * *